US007972245B2

(12) United States Patent
Temple et al.

(10) Patent No.: US 7,972,245 B2
(45) Date of Patent: Jul. 5, 2011

(54) PRESENTING INFORMATION TO USERS DURING AN ACTIVITY, SUCH AS INFORMATION FROM A PREVIOUS OR CONCURRENT OUTDOOR, PHYSICAL ACTIVITY

(75) Inventors: Sinclair Temple, Seattle, WA (US); Patrick Carney, Seattle, WA (US); Maura Collins, Seattle, WA (US); Valerie Goulart, Seattle, WA (US); Andrea Small, Seattle, WA (US); Joseph Ungari, Seattle, WA (US)

(73) Assignee: T-Mobile USA, Inc., Bellevue, WA (US)

( * ) Notice: Subject to any disclaimer, the term of this patent is extended or adjusted under 35 U.S.C. 154(b) by 129 days.

(21) Appl. No.: 12/395,587

(22) Filed: Feb. 27, 2009

(65) Prior Publication Data

US 2010/0222179 A1 Sep. 2, 2010

(51) Int. Cl.
*A63B 15/02* (2006.01)
*A63B 71/00* (2006.01)

(52) U.S. Cl. ..... 482/8; 482/1; 482/902

(58) Field of Classification Search ..... 482/1, 8–9, 482/901–902, 74; 600/595; 73/865.4; 434/247–255, 257; 715/704, 706, 709; 348/77, 348/14.01, 121, 552
See application file for complete search history.

(56) References Cited

U.S. PATENT DOCUMENTS 5,890,997 A * 4/1999 Roth ..... 482/8
6,142,913 A * 11/2000 Ewert ..... 482/8
6,152,856 A * 11/2000 Studor et al. ..... 482/8
6,283,896 B1 * 9/2001 Grunfeld et al. ..... 482/54
6,616,578 B2 * 9/2003 Alessandri ..... 482/8
6,626,799 B2 * 9/2003 Watterson et al. ..... 482/4
6,716,139 B1 * 4/2004 Hosseinzadeh-Dolkhani et al. ..... 482/1
6,736,759 B1 * 5/2004 Stubbs et al. ..... 482/8
6,902,513 B1 * 6/2005 McClure ..... 482/8
6,997,853 B1 * 2/2006 Cuskaden et al. ..... 482/8
7,072,789 B2 * 7/2006 Vock et al. ..... 702/141
7,220,220 B2 * 5/2007 Stubbs et al. ..... 482/72
7,558,526 B2 * 7/2009 Guo ..... 455/3.06
7,648,463 B1 * 1/2010 Elhag et al. ..... 600/504
7,658,694 B2 * 2/2010 Ungari ..... 482/1
7,670,263 B2 * 3/2010 Ellis et al. ..... 482/8
7,790,976 B2 * 9/2010 Takai et al. ..... 84/612
7,833,135 B2 * 11/2010 Radow et al. ..... 482/57
2001/0001303 A1 * 5/2001 Ohsuga et al. ..... 482/5
2001/0004622 A1 * 6/2001 Alessandri ..... 482/8
2002/0055419 A1 * 5/2002 Hinnebusch ..... 482/8
2005/0233859 A1 * 10/2005 Takai et al. ..... 482/3
2005/0233861 A1 * 10/2005 Hickman et al. ..... 482/8
2005/0239601 A1 * 10/2005 Thomas ..... 482/1
2006/0063644 A1 * 3/2006 Yang ..... 482/4
2006/0205569 A1 * 9/2006 Watterson et al. ..... 482/54
2007/0021269 A1 * 1/2007 Shum ..... 482/8
2007/0032344 A1 * 2/2007 Guo ..... 482/8
2007/0042868 A1 * 2/2007 Fisher et al. ..... 482/8
2007/0135264 A1 * 6/2007 Rosenberg ..... 482/8
2007/0219059 A1 * 9/2007 Schwartz et al. ..... 482/8

(Continued)

*Primary Examiner* — Loan Thanh
*Assistant Examiner* — Sundhara M Ganesan
(74) *Attorney, Agent, or Firm* — Perkins Coie LLP

(57) ABSTRACT

A system and method for providing information during an activity is described. In some examples, the system includes a capture device that captures information during a first activity and a presentation device that presents the information during a second activity. In some examples, system employs and is implemented on one or more mobile devices that transfer, process, and generate information based on performance of activities.

22 Claims, 11 Drawing Sheets

U.S. PATENT DOCUMENTS

2007/0260482 A1* 11/2007 Nurmela et al. ..... 705/2
2007/0287596 A1* 12/2007 Case et al. ..... 482/8
2008/0090703 A1* 4/2008 Rosenberg ..... 482/8
2008/0096726 A1* 4/2008 Riley et al. ..... 482/8
2008/0188353 A1* 8/2008 Vitolo et al. ..... 482/8
2008/0200312 A1* 8/2008 Tagliabue ..... 482/9
2008/0269018 A1* 10/2008 Nurmela et al. ..... 482/8
2009/0048070 A1* 2/2009 Vincent et al. ..... 482/8
2009/0163321 A1* 6/2009 Watterson et al. ..... 482/4
2009/0209393 A1* 8/2009 Crater et al. ..... 482/9
2010/0035725 A1* 2/2010 Rickerman ..... 482/8
2010/0035726 A1* 2/2010 Fisher et al. ..... 482/8
2010/0062818 A1* 3/2010 Haughay et al. ..... 463/7
2010/0105525 A1* 4/2010 Thukral et al. ..... 482/8

* cited by examiner

PRESENTING INFORMATION TO USERS DURING AN ACTIVITY, SUCH AS INFORMATION FROM A PREVIOUS OR CONCURRENT OUTDOOR, PHYSICAL ACTIVITY

BACKGROUND

Runners and other athletes use many different devices and gadgets during sports and other activities. For example, they may listen to music on an mp3 player, monitor their heart rate using a heart rate monitor, measure their distance or pace using a pedometer, and so on. Although these devices may enhance the athlete's experience, they generally only provide information about the athlete's performance.

Currently, mobile devices and related accessories facilitate communication in a number of different ways: users can send email messages, make telephone calls, send text and multimedia messages, chat with other users, and so on. That is, the mobile device provides a user with a plethora of means for oral or written communication. Moreover, they can play music, videos, and so on. However, there may be times when the user wishes to leverage a device's capabilities in order to provide other functions. Current mobile devices may not provide such functionalities.

The need exists for a method and system that overcomes these problems and progresses the state of the art, as well as one that provides additional benefits. Overall, the examples herein of some prior or related systems and their associated limitations are intended to be illustrative and not exclusive. Other limitations of existing or prior systems will become apparent to those of skill in the art upon reading the following Detailed Description.

Figure 1:
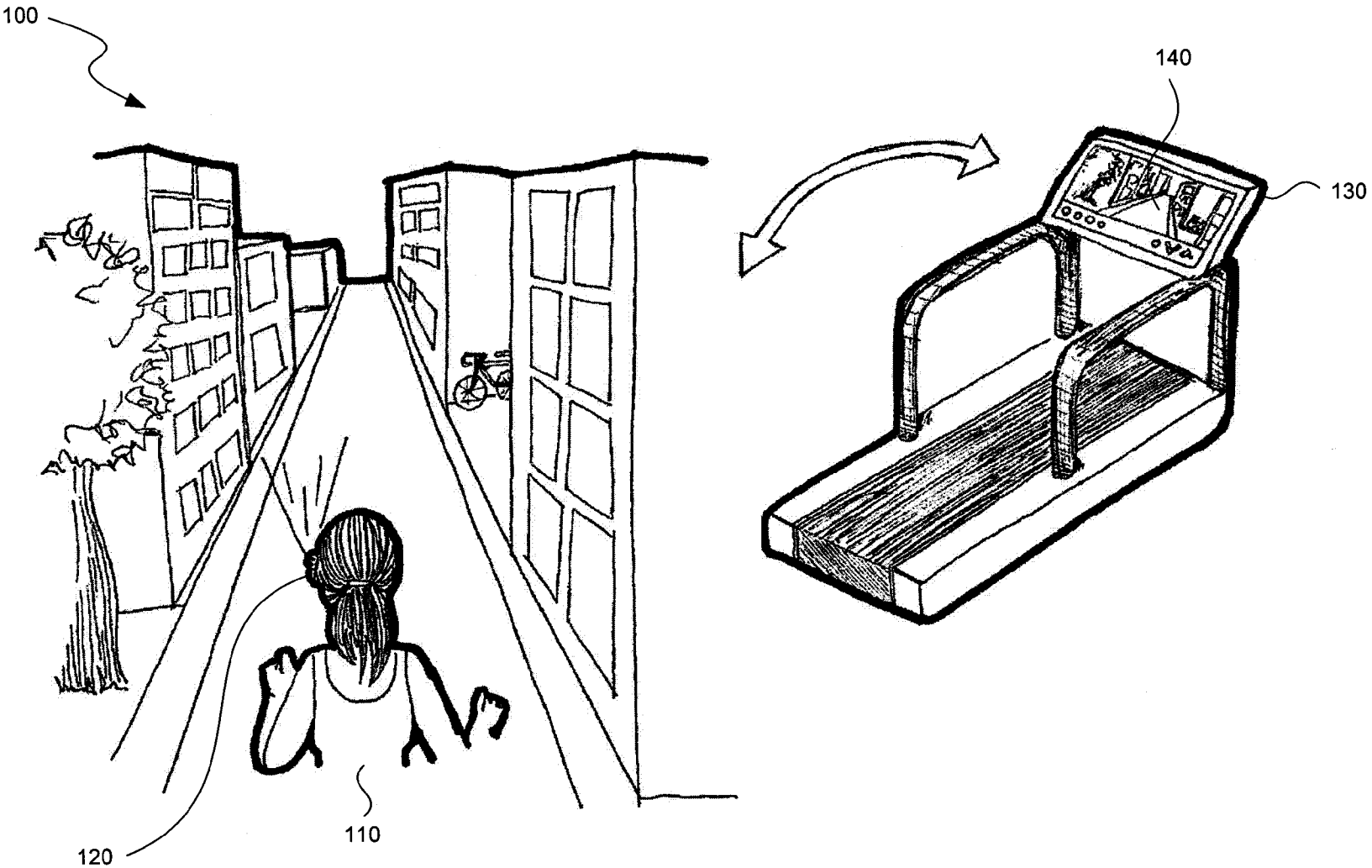
FIG. 1 is a pictorial diagram illustrating an example information capture and presentation system.

The headings provided herein are for convenience only and do not necessarily affect the scope or meaning of the claimed system.

DETAILED DESCRIPTION

A system and method for presenting information, such as visual information, during an activity is described. The system includes information capture devices and/or information presentation devices, which may or may not be associated with mobile devices. Collaboratively, the capture and presentation devices capture information during a first activity performed by a user and present the information during a second activity performed by the user, or by other users.

In some examples of the system, a capture device records information related to a first activity, such as a camera that records a video during an outdoor run, and transfers the information to an associated mobile device. The mobile device transmits the information over a network to another mobile device. The other mobile device receives the information and transfers the information to a presentation device, such as a display that presents the video during a second activity. In some examples, the system transfers information directly between the capture devices and the presentation devices via the network.

In some examples of the system, a capture device captures information during an activity for immediate transmission. For example, the capture device may be a camera that records video of an environment surrounding a runner during a run, a sensor that measures and records data related to the runner's pace, acceleration, time, and so on, and/or a location detection device that measures and records the runner's location continuously or at various intervals. The capture device may stream captured data to other devices performing similar activities in real-time, or may transfer captured data to storage devices to be later retrieved for presentation during a subsequent activity.

In some examples, the system transfers information during real-time performances of activities at two different locations. For example, during a run on a treadmill a runner may view a live or pre-recorded video of the environment surrounding a runner (concurrently) running in the woods. In some examples, the system records and stores information associated with a first activity, and presents the information during a second, later activity. For example, a runner may view a display of a previous performance during a subsequent run.

In some examples of the system, a presentation device displays information associated with a different and/or previous activity concurrently during performance of a current activity. In some cases, the presentation device may be a display located on equipment that facilitates activity, such as a treadmill, Stairmaster, rowing machine, climbing wall, and so on. In some cases, the presentation device may be worn by the user, such as via glasses or sunglasses.

Various examples of the system will now be described. The following description provides specific details for a thorough understanding and enabling description of these examples. One skilled in the relevant art will understand, however, that the system may be practiced without many of these details. Likewise, one skilled in the relevant art will also understand that the system incorporates many other obvious features not described in detail herein. Additionally, some well-known structures or functions may not be shown or described in detail below, so as to avoid unnecessarily obscuring the relevant description.

The terminology used below is to be interpreted in its broadest reasonable manner, even though it is being used in conjunction with a detailed description of certain specific examples of the system. Indeed, certain terms may even be emphasized below; however, any terminology intended to be interpreted in any restricted manner will be overtly and specifically defined as such in this Detailed Description section.

Suitable System

As discussed herein, the system facilitates presenting information captured during one activity to a user performing another similar activity. The activity may be walking, running, hiking, climbing, biking, swimming, skiing, participating in other sports or athletic activities, participating in other activities, and so on. Referring to FIG. 1, a pictorial diagram 100 illustrating an example system is shown. During her morning jog, an athlete 110 runs through a city. The athlete 110 wears a capture device 120 that includes a small video recorder (such as a video camera with Bluetooth). During the jog, the athlete 110 continuously records and/or captures a video of the environment around her. In addition, the athlete records her vital statistics (e.g., heartbeat), the outside temperature, time of run, time of day, pace of footfalls, and so on. At a different location, an indoor treadmill 130 presents the captured video when an athlete uses the apparatus. The treadmill includes a presentation device 140 that receives the captured video from the capture device 120 and presents the video. In this example, the video is streamed from the capture device 120 to the presentation device 140 in real-time, so an athlete running on the indoor treadmill 130 is able to view the environment seen by the athlete 120 running through the city, as well as interact with other measured parameters. The athletes, interacting in real-time, may also call one another, transmit voice or text messages of encouragement (or in response to the other's performance), and so on. Of course, this scenario is one of many possible scenarios contemplated by the system, some of which will be discussed in detail herein.

Figure 2A:
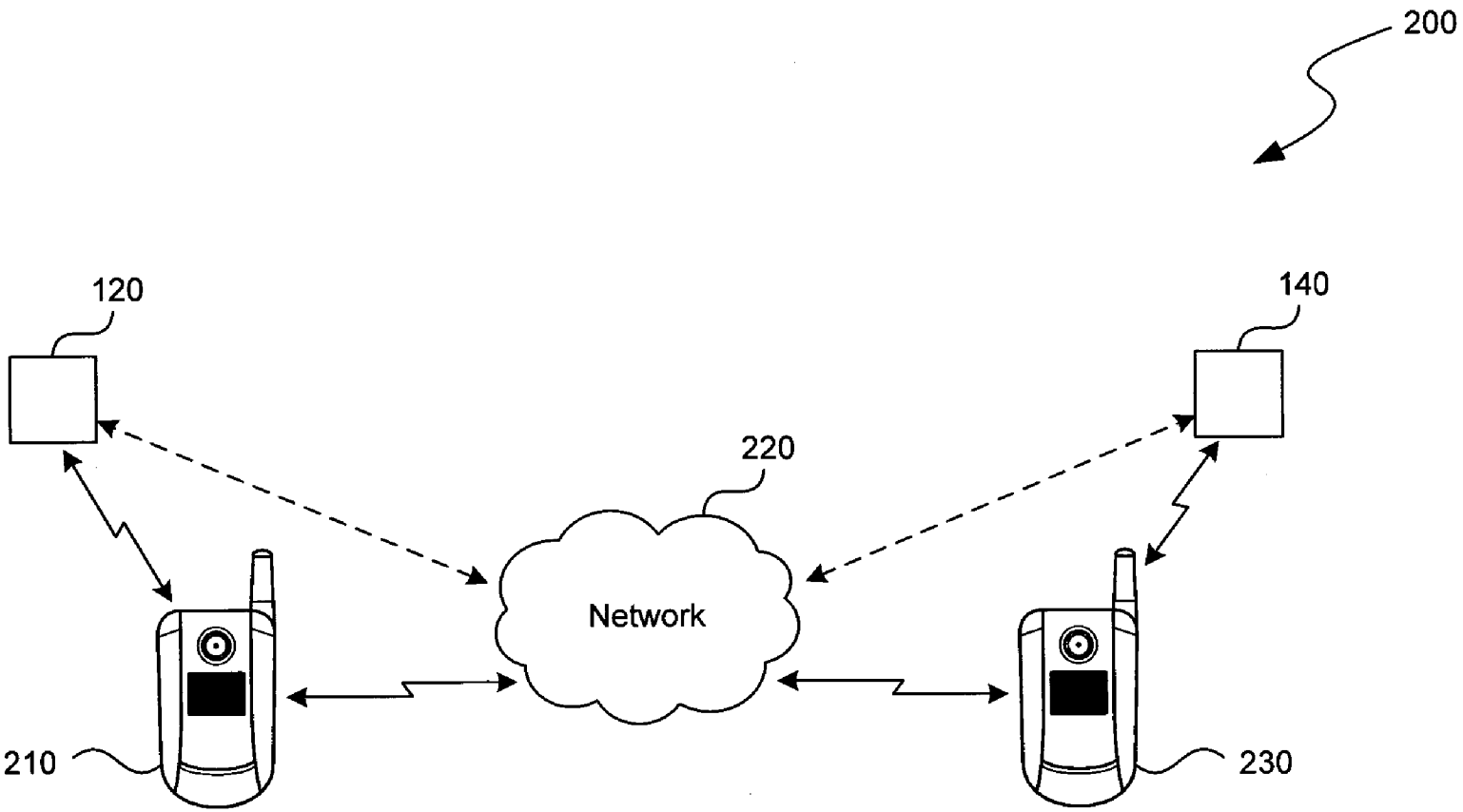
FIG. 2A is a block diagram illustrating a suitable system for providing information captured by a device during a first activity to a device within a second activity.

Referring to FIG. 2A, a block diagram illustrating a suitable system 200 for providing information captured by a device during a first activity to a device within a second activity is shown. Aspects of the system may be stored or distributed on tangible computer-readable media, including magnetically or optically readable computer discs, hardwired or preprogrammed chips (e.g., EEPROM semiconductor chips), nanotechnology memory, biological memory, or other data storage media. Alternatively or additionally, computer implemented instructions, data structures, screen displays, and other data under aspects of the system may be distributed over the Internet or over other networks (including wireless networks), on a propagated signal on a propagation medium (e.g., an electromagnetic wave(s), a sound wave, etc.) over a period of time, or they may be provided on any analog or digital network (packet switched, circuit switched, or other scheme).

The system 200 includes a capture device 120 associated with a first mobile device 210, a presentation device 140 associated with a second mobile device 230, and a network 220 that provides a communication link between the two mobile devices. Alternatively, or additionally, the capture and presentation devices may communicate directly via the network. Of course, the system 200 may include more capture and/or presentation devices, or may only include one device. Mobile devices 210, 230 may be a cell phone, laptop, PDA, smart phone, and so on.

Figure 2B:
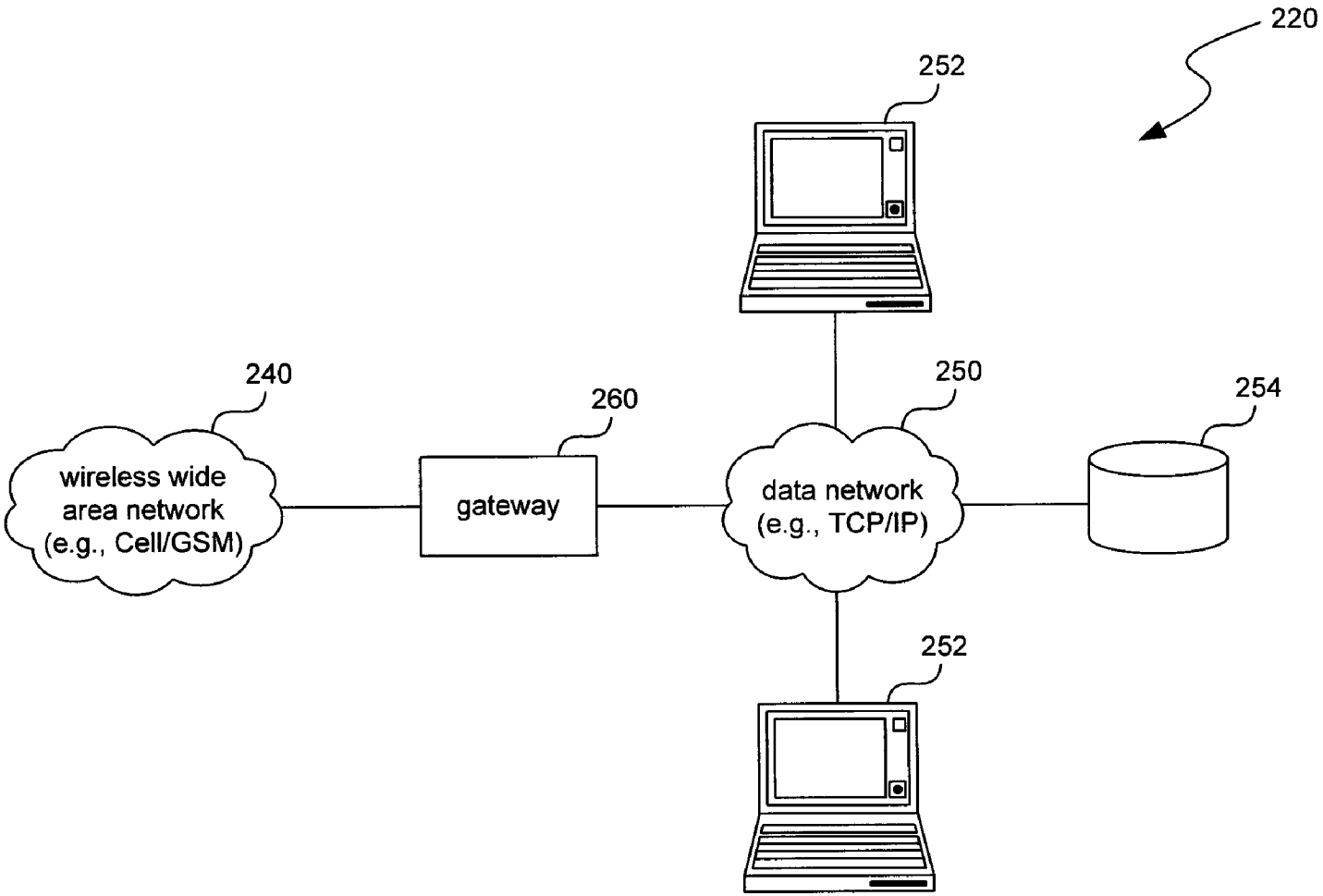
FIG. 2B is a block diagram illustrating suitable components within the network of FIG. 2A.

Referring to FIG. 2B, a block diagram illustrating suitable components within the network 220 is shown. The network 220 may include a cell or GSM-based network 240 that communicates with an IP-based network 250 via a gateway 260. The IP-based network 250 may include or communicate with one or more user computing devices 252, a database 254, and so on. The user computing devices 252 may display and/or present information to users of the devices 120, 140 described herein, such as information stored in the database 254. Examples of presented information include: information related to a performed activity, information related to activities recorded or presented using the devices, information related to modifying or changing parameters associated with the devices, and so on. Further details are discussed herein.

The network 220 may include any network capable of facilitating communications between devices, and is not limited to those shown in FIG. 2B. Examples include GSM (Global System for Mobile Communications), UMA/GAN (Unlicensed Mobile Access/Generic Access Network), CDMA (Code Division Multiple Access), UMTS (Universal Mobile Telecommunications System), EDGE (Enhanced Data for GSM Evolution), LTE (Long Term Evolution), Wimax (Worldwide Interoperability for Microwave Access), Voice Over Internet Protocol (VoIP), TCP/IP, and other technologies. Thus, unlike previous systems of paired devices (walkie-talkies, and so on) that are limited to short distance communications, the system 200 enables communications over longer distances (e.g., 1 mile or more).

In some cases, the cell-based networks 240 incorporate picocells, small base stations having short wireless ranges and generally located in residential or business locations to provide local coverage to that location. Picocells may be directly connected to a network, and often appear as cell sites having a Cell Global Identity (CGI) value within the network.

In some cases, the IP-based networks 250 (e.g., UMA networks) incorporate femtocell networks. Similar to VoIP, in femtocell networks voice communications are packetized and transmitted over the Internet. UMA networks typically feature WiFi access points for receiving and sending voice communications over an unlicensed spectrum; femtocell networks typically feature wireless access points broadcasting within licensed spectrums of a telecommunications service provider, with conversion of voice communications into IP packets for transmission over the Internet.

The capture, presentation, and/or associated mobile devices may include some or all components necessary to capture information during one activity and present that information during another activity. The devices 120, 140, 210, 230 may include an input component capable of facilitating or receiving user input to begin an information capture, as well as an output component capable of presenting information to a user.

These devices may also include a communication component configured to communicate information, messages, and/or other data to other devices, to associated mobile devices, to other devices within an affiliated network, and so on. The communication component may transmit information over various channels, such as voice channels, data channels, control channels, command channels, and so on.

In some cases, the communication component is a Bluetooth component capable of transmitting information to an associated mobile device (e.g., devices 210, 230) that prompts the mobile device to transmit information to other devices. For example, a device pairs with a mobile device and uses one of several known Bluetooth profiles to communicate. In some cases, the communication component is a WiFi component or other IP-based component capable of transmitting data packets over a wireless channel to an associated mobile device or to other devices within a network. Of course, the communication component may include some or all of these components.

Captured and/or presented information may be stored in a memory component along with a data structure or map that relates the information to other captured and/or presented information. In some cases, the communication component is a radio capable of transmitting information over a cellular network, such as those described herein. The memory component may include, in addition to a data structure storing information about an activity, information identifying what devices are to receive the stored information. For example, the information may identify names of other devices, IP addresses of other devices, other addresses associated with other devices, and so on. The following tables illustrate types of information stored in various communication devices.

The devices may also include other components that facilitate its operations, including processing components, power components, additional storage components, additional computing components, and so on. The processing component may be a microprocessor, microcontroller, FPGA, and so on. The power component may be a replaceable battery, a rechargeable battery, a solar-powered battery, a motion-generating component, and so on. Of course, the devices may include other components, such as GPS components to measure location, cameras and other visual recording components, motion detection components (e.g., accelerometers), audio speakers and microphones (such as those found in mobile devices and mobile accessories), and so on. Further examples of suitable devices and their components will be described in detail herein.

Figure 3:
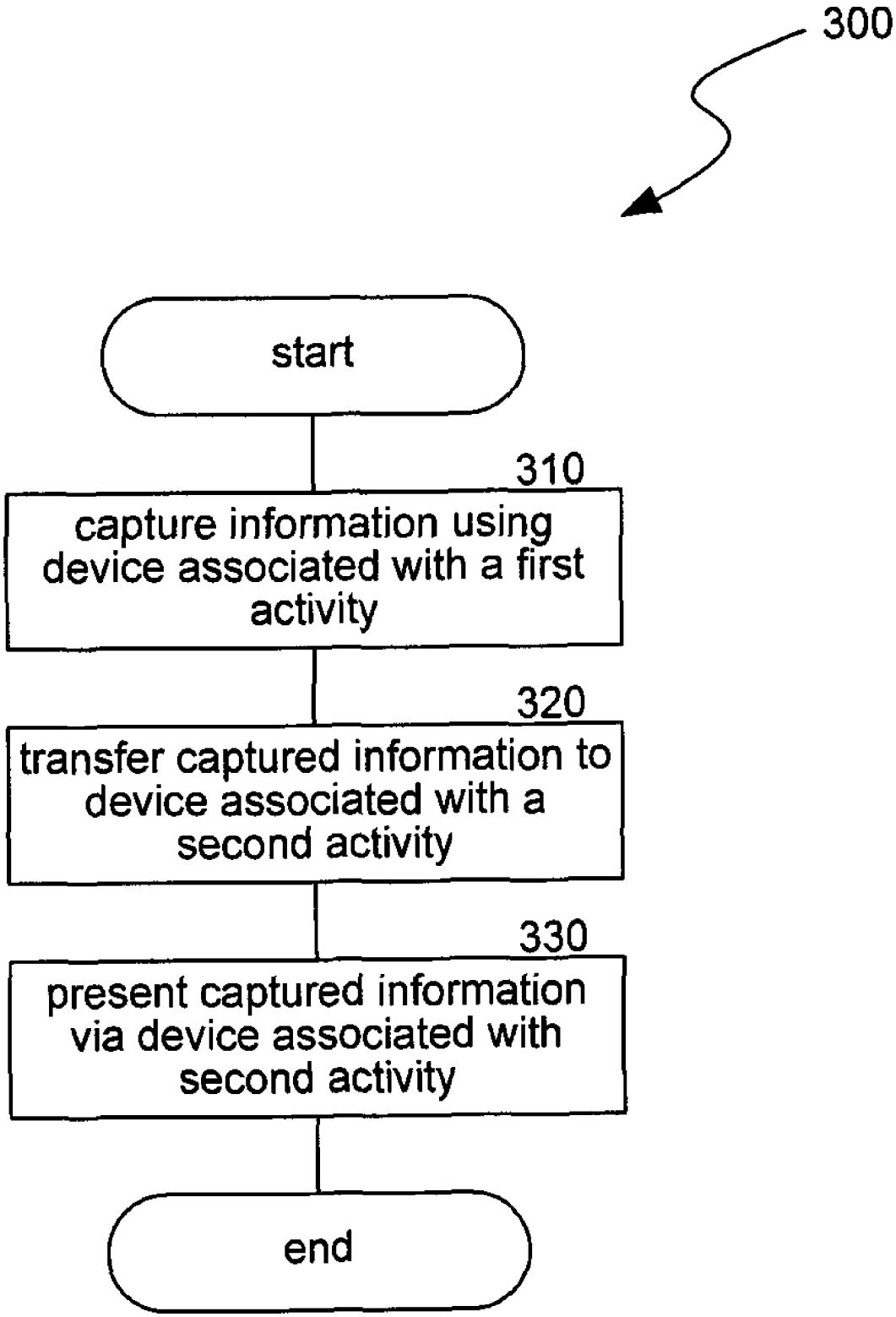
FIG. 3 is a flow diagram illustrating a routine for presenting information during an activity.

As discussed herein, the system presents information captured from a first activity to a user of a second activity. Referring to FIG. 3, a flow diagram illustrating a routine 300 for presenting information during an activity is shown. In step 310, the system captures information using a capture device associated with a first activity. The captured information may include visual information (such as recorded video or photographs), biometric information (e.g. heart rate), performance metric information (such as a pace, time, date, weather, calories burned, distance, location, and/or other parameters associated with the first activity), and/or other information. Further details regarding the capture of information are discussed herein.

In step 320, the system transfers the captured information to a presentation device associated with a second activity. The system may transfer the information over a network that includes the presentation device, may transfer the information over a network that includes a mobile device associated with the presentation device, may transfer the information to a storage device, and so on. The transfer between devices may be real-time or may occur sometime after the capture of information (such as when prompted by a user wanting access to the information). Further details regarding the transfer of information are discussed herein.

In step 330, the system presents the captured information via the presentation device within or during the second activity. The presentation device may be a number of different devices, includes a stand alone device, a device attached to or integrated with athletic equipment (e.g., a treadmill, rowing machine, stationary bicycle, stepping machine, and so on), a wearable device (e.g., glasses capable of displaying information to a user), and so on. The presentation device may display the captured information in a number of ways. For example, the presentation device may integrate the captured information with information associated with an athlete's performance of the second activity, may present the information when an athlete achieves certain performance standards during the second activity or arrives at certain locations, and so on. Further details regarding the presentation of information and types of presentation devices are discussed herein.

Capturing Information During an Activity

Figure 4:
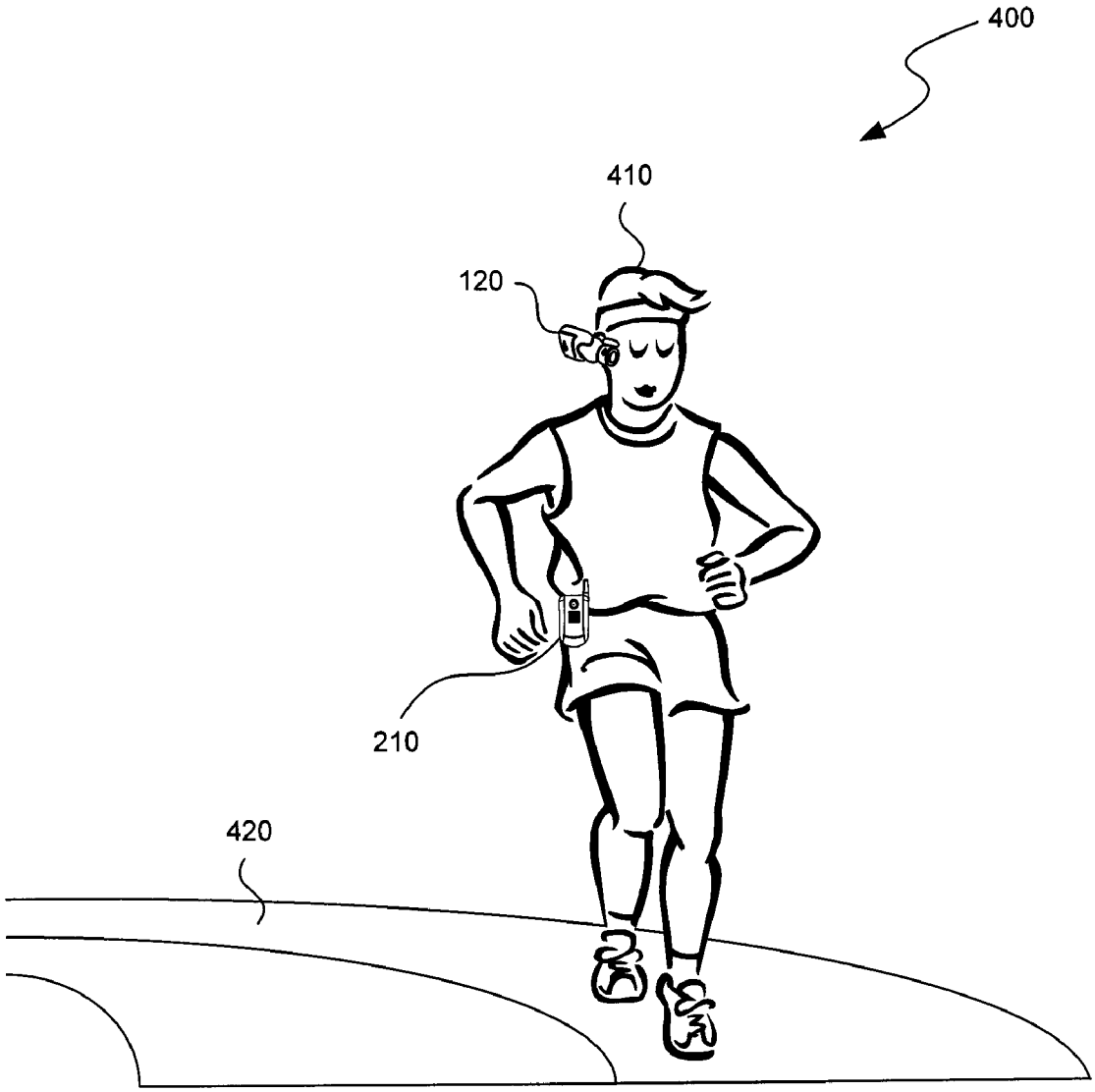
FIG. 4 is a pictorial diagram illustrating an example capture device.

As described herein, the system captures information in a variety of ways during performance of an activity, which is later presented during performance of a similar or different, geographically remote activity. Referring to FIG. 4, a pictorial diagram 400 illustrating an example capture device is shown. A capture device 120 is worn by a runner 410 running around a track 420. The runner also wears an associated mobile device 210. In this example, the capture device 120 includes a camera capable of recording and streaming visual data seen by the runner 410 and captured by the capture device 120. The capture device 120 may also include other components, such as a GPS device that monitors, records, and tags a location of the runner 410 (or, alternatively, an RFID or similar tag that communicates with similar tags around the track to track the runner's position), an accelerometer that monitors and records a pace of the runner 410, a biometric reader such as a heart rate monitor, an audio recorder, and so on For example, the capture device 120 may include an mp3 player with Bluetooth capabilities that streams music to the runner and to associated runners in real-time. As another example, the capture device 120 may measure a runner's heartbeat or steps, which is transmitted to other runners to cause similar haptic responses for a group of runners (i.e., the group of runners, in different locations, may feels as though they are running together stride for stride). Thus, the capture device 120 is capable of and configured to measure parameters associated with the runner 410 during an activity, to record and stream video of the environment surrounding the runner 410, and so on, and/or other information. Other examples of suitable capture devices 120 include heart rate monitors, accelerometers, the LifeVest by ZOLL Lifecor, Inc., temperature sensors, pressure sensors, wind sensors, and so on.

Figure 5:
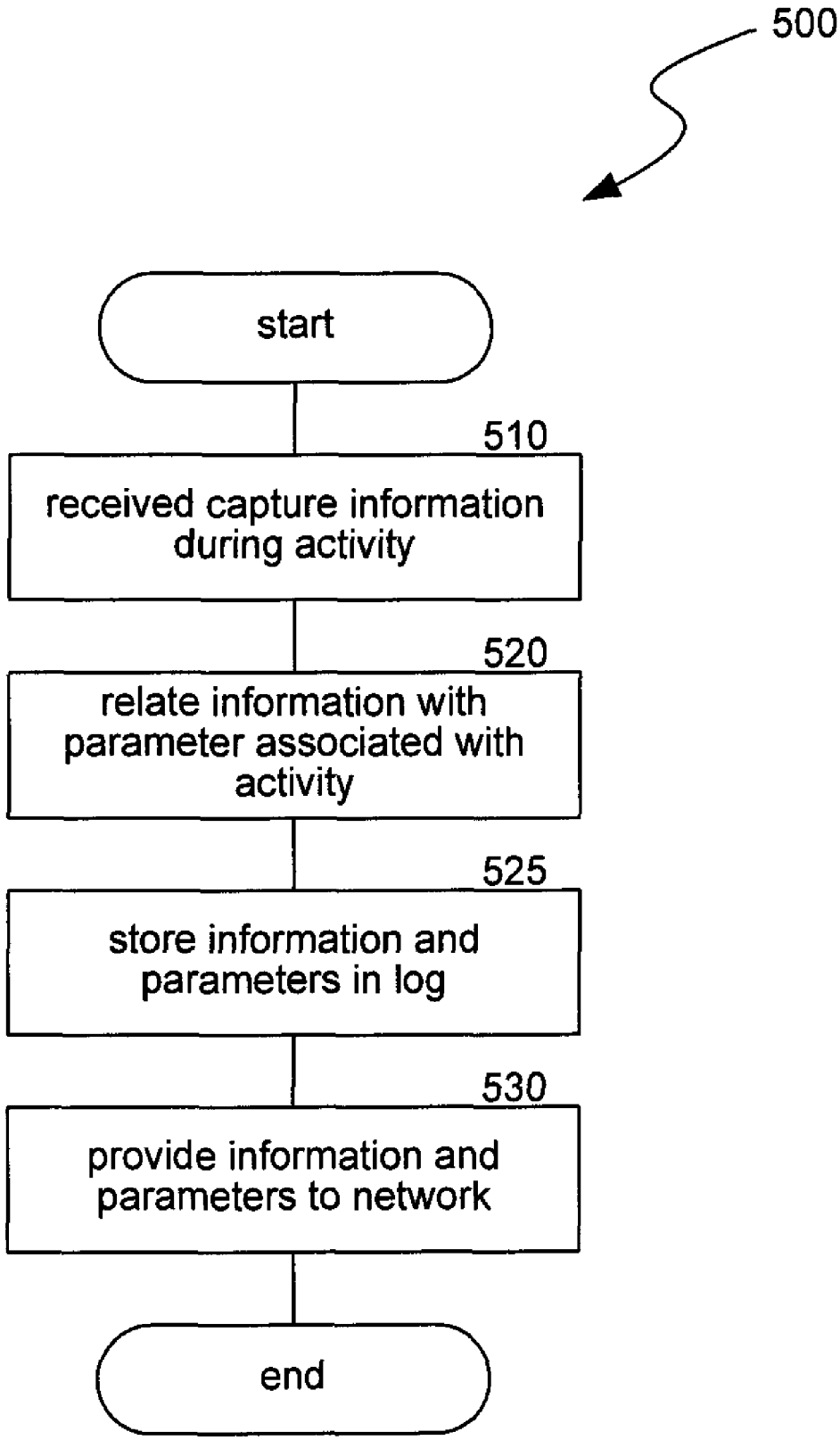
FIG. 5 is a flow diagram illustrating a routine for capturing information during performance of an activity.

Referring to FIG. 5, a flow diagram illustrating a routine 500 for capturing information during performance of an activity is shown. In step 510, the system receives information captured during an activity, such as information captured by a capture device 120. The information may be visual information (such as video or photographs), may be performance metrics associated with the activity (such as metrics associated with the speed of an athlete during the activity, the location of the athlete during the activity, and so on).

In step 520, the system relates the captured information with parameters associated with the activity, such as some or all of the captured parameters. For example, the system may tag frames within a captured video with location or pace information. The following table illustrates a portion of a data structure created by the system that relates a captured video with other parameters:

TABLE 1

| Frame Number | Location | Speed |
|---|---|---|
| 1 | 0 meters | 0 m/sec |
| 40 | 10 meters | 6 m/sec |
| 80 | 20 meters | 8 m/sec |
| 140 | 30 meters | 8 m/sec |

Of course, the system may relate other metrics (such as time) not shown in the Table to captured information.

The system, in step 525, may store the information of table 1, and any captured information, in a data structure, log, table, and so on. The system may store the information in a memory component of an associated mobile device 210, in a storage device 254 within the network (such as a web location capable of streaming video), in the capture device 120, or within other devices.

In step 530, the system provides the visual information and related parameters to a network associated with the capture device and/or associated mobile device. In some cases, the system provides the data in real-time. That is, the system streams the information from a capture device 120 or from an associated mobile device 210. The information may be first compressed, buffered, or otherwise conditioned before being sent to the network, or may be sent in its native format. For example, an associated mobile device may first transform the information to an .mp3, .wav, .mpeg3, .mpeg4 or other audio or video file, and then provide the file to the network.

Transferring Information from a Capture Device to a Presentation Device

Figure 6:
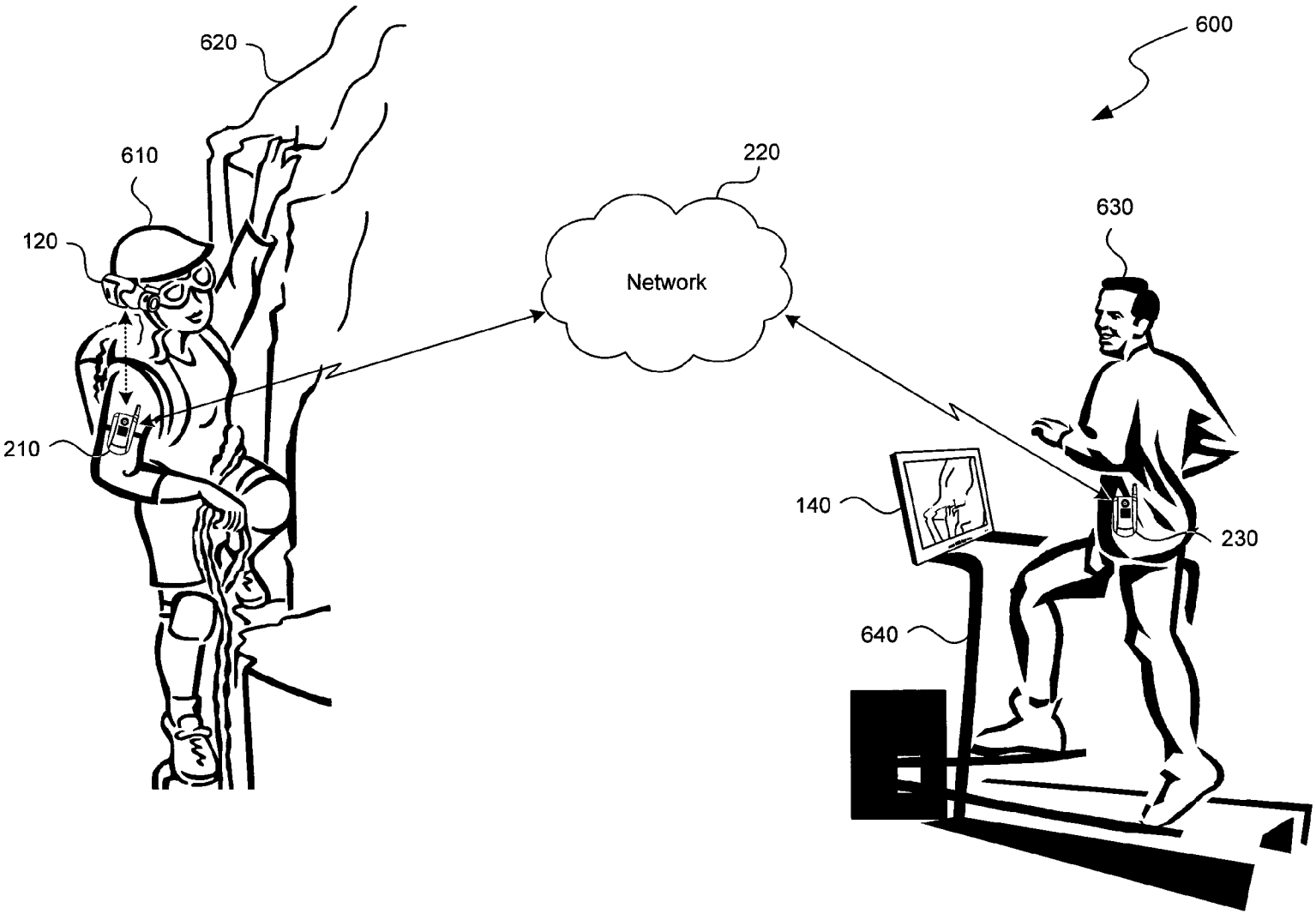
FIG. 6 is a pictorial diagram illustrating an example system for transferring information between devices.

As described herein, the system transfers information in a variety of ways between a capture device and a presentation device. Referring to FIG. 6, a pictorial diagram 600 illustrating an example system for transferring information between devices is shown. A mountain climber 610 is climbing a mountain 620. A capture device 120, which includes a video recorder and elevation sensor, captures visual information and parameters associated with the activity of climbing the mountain. The capture device 120, via a Bluetooth connection, transfers the information to an associated mobile device 210. The mobile device 210 streams the information over a network 220 to a mobile device 230 associated with an athlete 630 in a gym exercising on a stair climber 640. The mobile device 230 transfers the received information to a presentation device 140 attached to the stair climber 640, which displays the visual information seen by the mountain climber 610 to the athlete 630 exercising in the gym.

Figure 7:
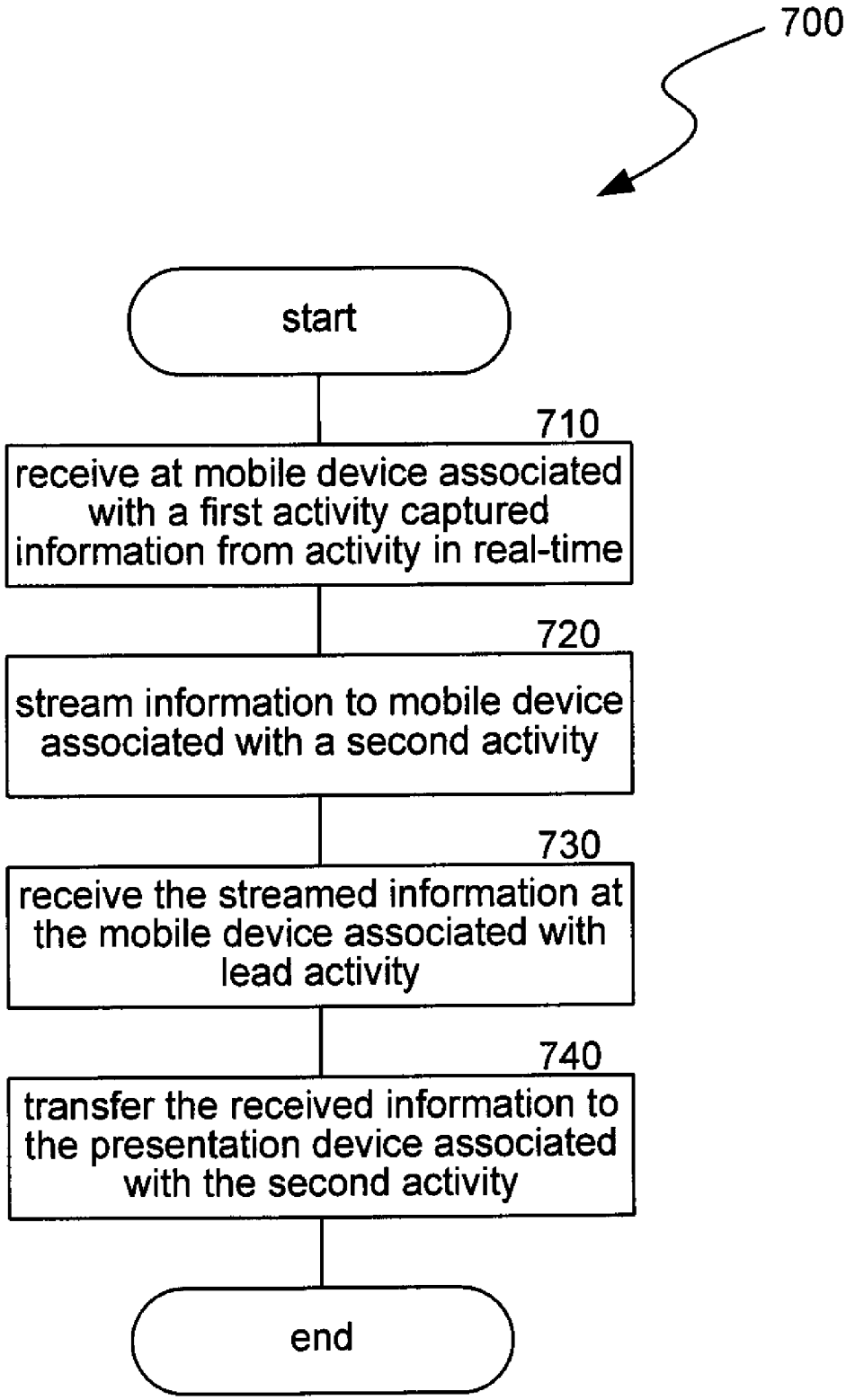
FIG. 7 is a flow diagram illustrating a routine for transferring information from a capture device to a presentation device.

Referring to FIG. 7, a flow diagram illustrating a routine 700 for transferring information from a capture device to a presentation device is shown. In some cases, the routine is performed by tangible components, containing software, stored on one or more mobile devices associated with the capture device and/or the presentation device.

In step 710, a mobile device associated with a first activity receives information captured during the activity by a capture device attached to or proximate to a user performing the activity. For example, a bicyclist records the environment he/she is riding through using a capture device attached to his/her helmet, and the mobile device receives the recorded information (e.g., the visual data) as well as other information associated with the route (such as user generated about the environment, certain mile markers, trivia about the route, and so on) taken by the bicyclist or information associated with the activity itself.

In step 720, the mobile device associated with the first activity streams or otherwise transfers the received information to a second mobile device associated with a user performing a second activity. The first mobile device may stream or transfer the information in real-time, or may buffer the information to stream or transfer the information at a later time. Following the example, the mobile device of the bicyclist transfers a video recording of the route to a mobile device associated with his/her friend performing or about to perform a second activity.

In step 730, the mobile device associated with the second activity receives the streamed information. The mobile device may store the received information, buffer the received information, or otherwise condition the received information for suitable presentation. In step 740, the mobile device associated with the second activity transfers the received information to a presentation device attached to or proximate to the user performing the second activity. Following the example, the mobile device transfers the information to a display proximate to the friend, who is riding a stationary bike in a gym.

Of course, one skilled in the art will recognize that the system may use or leverage other methods, components, or protocols know in the art when transferring information between devices.

Presenting Information During an Activity

As described herein, the system presents information in a variety of ways and via a number of different presentation device types. The system may present information in real-time, or may present pre-recorded information. Of course, the system may present multiple types of information, providing visual and other information during an activity that is at least partially dependent on a user's performance of that activity. In some cases, the systems integrates, tags, or otherwise links or correlates types of information (such as shown in Table 1), and may present information based on these correlations. In some cases, the system adjusts the presentation of information during an activity based on dynamically measuring performance metrics during the activity.

Figure 8:
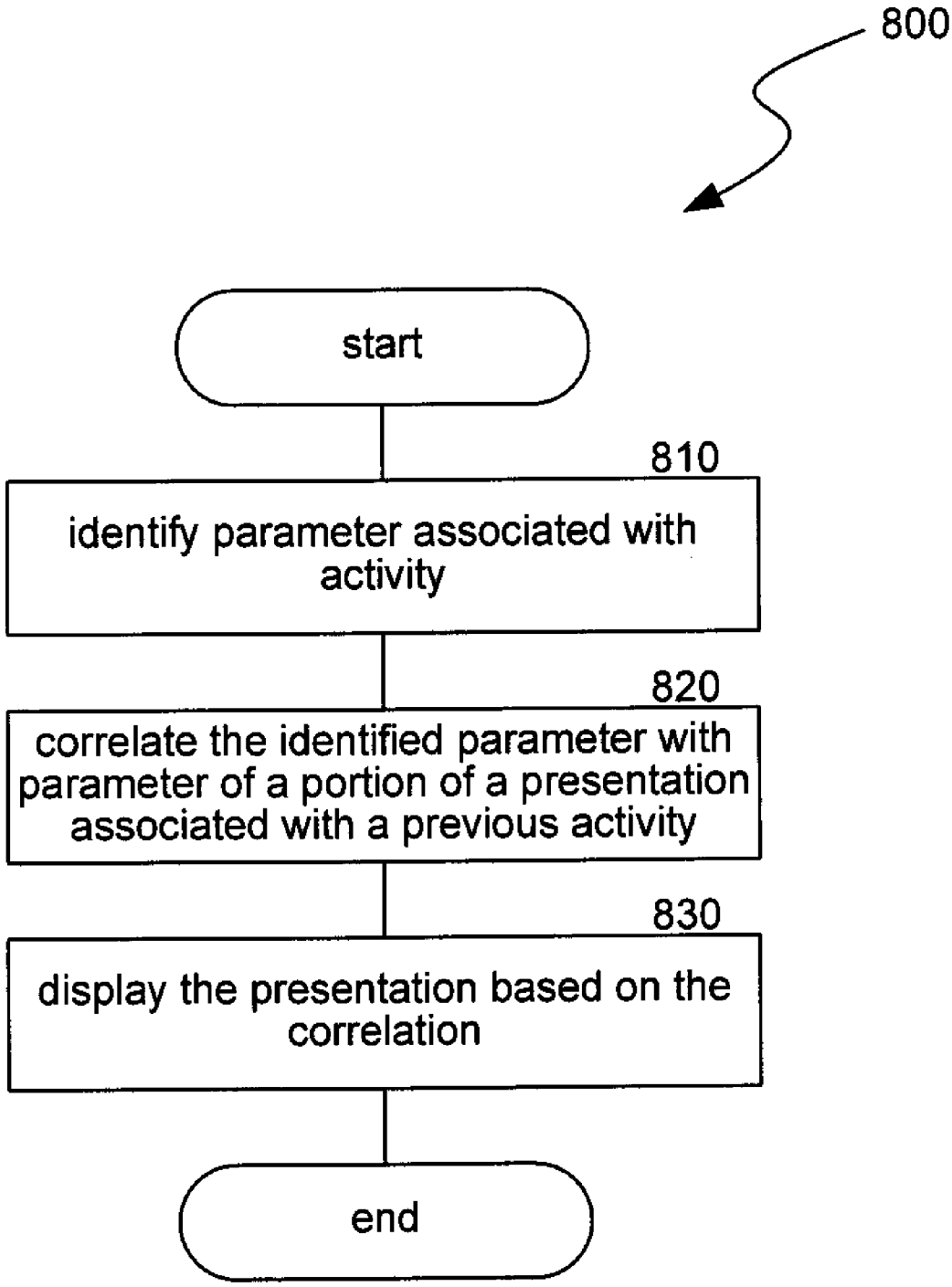
FIG. 8 is a flow diagram illustrating a routine for presenting information during an activity.

Referring to FIG. 8, a flow diagram illustrating a routine 800 for presenting information during an activity is shown. In step 810, the system, via a presentation device 140 or via an associated mobile device 230, identifies and/or measures a parameter associated with an activity performed by an athlete. For example, the system measures the speed of an athlete during a run on a treadmill. Other example parameters include:

- speed, velocity, or acceleration of the user (or associated device);
- distance traveled by the user;
- GPS location of the user;
- relative distance traveled by the user (such as a user's location on a track);
- angle of inclination of a surface;
- duration of activity;
- temperature and other environmental parameters;
- heart rate and other human parameters;
- user input parameters, such as whether a user's goals (ideal speed, heart rate) are met, and so on.

In step 820, the system correlates the identified parameter with a parameter associated with a presentation for a previously performed activity. Following the example, the system correlates the speed of the athlete with a frame velocity for the presentation.

In step 830, the system displays the presentation to the athlete based on the correlation. For example, the system may play the presentation at a speed that correlates the athlete's speed with the speed of the athlete that recorded the presentation. That is, if the athlete performing the activity is slower than the athlete that recorded the presentation, the system will play the presentation at a slower speed in order to correlate the presentation to the slow athlete's speed.

As discussed herein, the system may correlate an aggregate/average of historical metrics and current metrics for a single athlete's performance of an activity. The system may present the historical information of an activity during a current activity. The system may also present other historical information during a current activity, such as historical metric from other athletes.

As discussed herein, the system contemplates the use of many different presentation devices. Examples include displays attached to or integrated with exercise equipment, displays proximate to an activity (such as video screens around a track), and wearable displays, including glasses, sunglasses, visors, hats, and so on.

Figure 9:
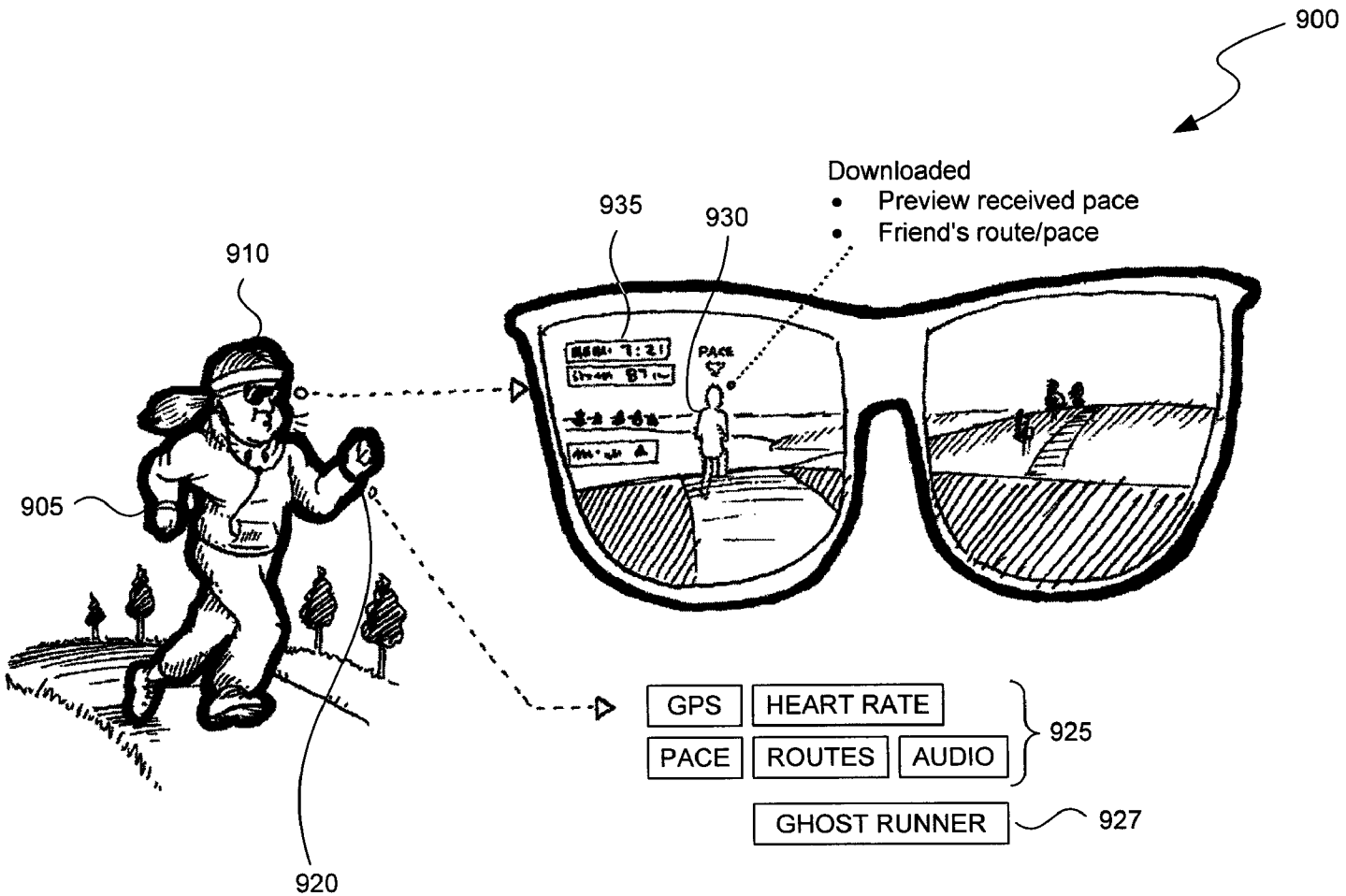
FIG. 9 is a pictorial diagram illustrating an example presentation device integrated into eyewear.

For example, the presentation device may be a pair of glasses worn by a user that display information to the user via the lenses of the glasses. Such a device may be, for example, "mobile device eyewear" by Microvision, Inc., of Bellevue, Wash., or other suitable devices that may include micro-projectors or other small light emitting components. Referring to FIG. 9, a pictorial diagram 900 illustrating an example presentation device integrated into eyewear is shown. A user 905 wears eyeglasses 910 and a control device 920, which may be a watch, an associated mobile device, and so on. The control device 920 may facilitate user input to receive requests for various displayed metrics 925, such as heart rate, pace, and so on. The control device 920 may also include an input 927 associated with a ghost runner, to be discussed shortly. The glasses facilitate the presentation of information to the user, such as information associated with the user's performance 935, and information associated with a previous performance of the activity 930, in this example a virtual, or ghost, runner displayed in the lens of the glasses or other similar display devices.

Thus, the presentation device, using techniques known to those skilled in the art, presents a user with information about his/her performance (e.g., numerical information 935) in collaboration with information about a previous performance (e.g., the virtual runner 930).

Figure 10:
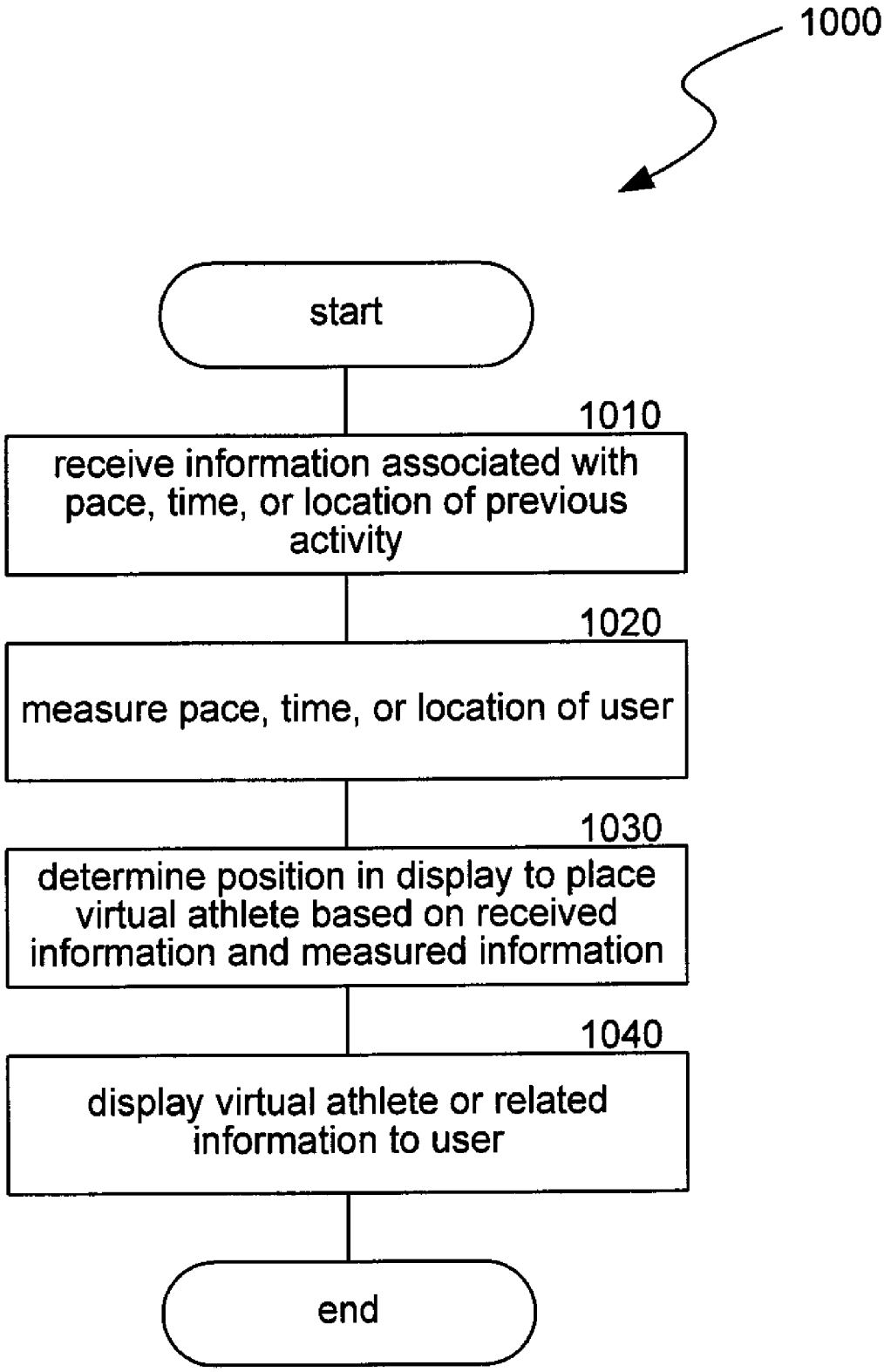
FIG. 10 is a flow diagram illustrating a routine for presenting a virtual athlete to an athlete performing an activity.

Referring to FIG. 10, a flow diagram illustrating a routine 1000 for presenting a virtual runner to an athlete performing an activity is shown. In step 1010, the system receives information, such as time or location information, associated with a user that previously performed the activity. The system may record the information from an activity performed by a user or performed by other users. For example, a first athlete may participate in a mile long run, and the system receives information associated with that performance.

In step 1020, the system measures parameters associated with a performance of a similar activity by a second user. The system may dynamically measure the parameters, may continuously measure the parameters, may periodically measure the parameters, and so on. The measured parameters may be parameters discussed herein, such as duration, location, pace, or other parameters. Following the example, the system measures parameters associated with a second athlete also participating in a mile long run.

In step 1030, the system determines a position in a presentation device associated with the second athlete to place a virtual athlete. As discussed herein, the virtual athlete may be any displayed image, such as a graphical object or other representation of an image. Alternatively, or additionally, the system may present descriptive information instead of an image, such as the phrases "3 meters ahead" or "catching up to you." The system may determine the position based upon the received information, the measured parameters, or both. Although not specifically discussed, the system may generate the graphical object and/or position the object based on a number of techniques or using a variety of different authoring software known to those skilled in the art. Following the example, the system determines the second athlete is 4 seconds behind the virtual athlete, and generates a graphical object, such as animation of a runner, to indicate such a state. Of course, the system may generate multiple graphical objects, such as objects that depict a group of runners to simulate a race, a group of bikes to simulate a peloton, and so on.

In step 1040, the system displays the virtual athlete to the second athlete during the performance of the activity by the second athlete. Of course, the system may continuously or periodically adjust the position in the display based on the second athlete's performance. Following the example, the system displays a graphic showing a runner 4 seconds ahead of the second athlete. Should the second athlete speed up, the system may show the virtual athlete slowing down, or even leaving the display when the second athlete overtakes the virtual athlete. The system may facilitate switching between a animated view and a textual view via a visual representation, such as an animated avatar or representative icon, which causes a display to switch back and forth between written phrases and visual images (e.g., an avatar switches to the written phrase "User 3 Meters Behind" when the athlete passes the avatar).

EXAMPLE SCENARIOS

Scenario 1: An up and coming athlete is training for a 400 meter race, and wants to train against a former world champion. The system retrieves information from a previous recording of a race by the former world champion, and transfers the information to a presentation device associated with the athlete. The presentation device includes a small sensor attached to the athlete's clothing as well as various display screens placed around a track used for training. The athlete begins his training run, and the system uses parameters of the training run and information from the retrieved recording to display on the screens a virtual race between the athlete and the world champion, which is viewable to the athlete both during the race and afterwards.

Scenario 2: Two former running partners live on opposite sides of the country, but wish to run together. The first partner runs outside in New York City, and the second partner runs on a treadmill in her basement. The first partner attaches a small camera to her running hat and her mobile device to her running belt, and records her run through the city. The second partner, running at the same time, views the city in real-time via a display on her treadmill by receiving information from the camera via the mobile device at the display. They may also be speaking to each other via their mobile devices.

Scenario 3: A bicyclist and his friend would like to race one another over 50 miles. They live in different locations, but begin to ride, each having small sensors attached to their bikes that record parameters associated with their speed and transmit these parameters to associated mobile devices. They also have small interfaces attached to their bikes that present information about their own race as well as information about the other rider's race. For example, the interfaces may be presentation devices as described herein that include computing components and communication components (such as Bluetooth links) in order to transmit and receive information from the associated mobile devices. Thus, they can follow each other's progress while also following their own. In addition, via a communication channel between the associated mobile devices, they can also speak with one another during the race, providing additional information to each other (or to egg each other on), listen to the same music, among other benefits.

Scenario 4: Seven friends "meet" at a certain time, regardless of their location, to exercise together. They all ride at the same time, following one of the friends' path while all talking and discuss the route. They also see, via a display on their bikes, their relative position with other another based on their distance traveled.

These scenarios are a few of many possible implementations, of course others are possible.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the system is not intended to be exhaustive or to limit the system to the precise form disclosed above. While specific examples for the system are described above for illustrative purposes, various equivalent modifications are possible within the scope of the system, as those skilled in the relevant art will recognize. For example, while aspects of the system are described above with respect to capturing and routing digital images, any other digital content may likewise be managed or handled by the system provided herein, including video files, audio files, and so forth. While processes or blocks are presented in a given order, alternative implementations may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times.

The teachings of the system provided herein can be applied to other systems, not necessarily the system described above. The elements and acts of the various examples described above can be combined to provide further implementations of the system.

Other changes can be made to the system in light of the above Detailed Description. While the above description describes certain examples of the system, and describes the best mode contemplated, no matter how detailed the above appears in text, the system can be practiced in many ways. Details of the system may vary considerably in its specific implementation, while still being encompassed by the system disclosed herein. As noted above, particular terminology used when describing certain features or aspects of the system should not be taken to imply that the terminology is being redefined herein to be restricted to any specific characteristics, features, or aspects of the system with which that terminology is associated. In general, the terms used in the following claims should not be construed to limit the system to the specific examples disclosed in the specification, unless the above Detailed Description section explicitly defines such terms. Accordingly, the actual scope of the system encompasses not only the disclosed examples, but also all equivalent ways of practicing or implementing the system under the claims.

We claim:

1. A system for presenting a multimedia presentation to a user performing an athletic activity, the system comprising:

a data capture component located where a first user is performing a first activity, wherein the data capture component is configured to be wearable by the first user and includes:

a visual capture component, wherein the visual capture component captures real-time visual data associated with the first activity performed by the first user;

a motion capture component, wherein the motion capture component captures real-time movement data of the first user during performance of the first activity; and a location determination component, wherein the location determination component determines one or more geographic locations of the first user during performance of the first activity; and a presentation component, wherein the presentation component includes:

a reception component located where a second user is performing a second activity, wherein the reception component is located geographically remotely from the first data capture component, wherein the second activity is different from the first activity, and wherein the reception component is configured to:

receive real-time visual data captured by the visual capture component, receive movement data captured by the motion capture component; and receive data associated with the one or more determined geographic locations of the first user from the location determination component;

a processing component, wherein the processing component is configured to process the received data; and a display component, wherein the display component is configured to display a representation of the processed data to the second user.

2. The system of claim 1, wherein the data capture component includes:

a data transmission component, wherein the data transmission component is configured to transmit the captured data to a mobile device associated with the first user for transmission to the second user.

3. The system of claim 1, wherein the reception component is configured to receive the captured data from a mobile device associated with the second user.

4. The system of claim 1, wherein the reception component is configured to receive the captured data from a mobile device associated with the first user.

5. The system of claim 1, wherein the display component is a display associated with a treadmill, a stationary bike, a rowing machine, or a stepping machine.

6. The system of claim 1, wherein the display component is a display associated with a pair of glasses.

7. The method of claim 1, wherein the first activity includes: walking, running, biking, swimming, or climbing.

8. A method for presenting a multimedia presentation to a user performing an athletic activity, the method comprising:

providing captured real-time visual data associated with a first activity performed by a first user;

providing captured real-time movement data of the first user during performance of the first activity; and providing data associated with one or more geographic locations of the first user determined during performance of the first activity; and at a geographic location of a second user, wherein the geographic location of the second user is remote from a geographic location of the first user, and wherein the second user is performing a second activity different from the first activity:

receiving real-time visual data associated with the first activity performed by the first user;

receiving real-time movement data of the first user captured during performance of the first activity;

receiving data associated with the one or more geographic locations of the first user determined during performance of the first activity;

processing the real-time visual data, the real-time movement data, and the data associated with the one or more geographic locations of the first user, wherein a processor executes instructions stored in a memory to process the real-time visual data, the real-time movement data, and the data associated with the one or more geographic locations of the first user; and displaying a representation of the processed data to the second user.

9. The method of claim 8, further comprising:

transmitting the real-time visual data, real-time movement data, and data associated with the one or more geographic locations to the second user.

10. The method of claim 8, wherein the second user receives the real-time visual data, the real-time movement data, and the data associated with the one or more geographic locations of the first user from a mobile device associated with the second user.

11. The method of claim 8, wherein the second user receives the real-time visual data, the real-time movement data, and the data associated with the one or more geographic locations of the first user from a mobile device associated with the first user.

12. The method of claim 8, wherein displaying the representation of the processed data is via a display associated with a treadmill, a stationary bike, a rowing machine, or a stepping machine.

13. The method of claim 8, wherein displaying the representation of the processed data is via a display associated with a pair of glasses.

14. The method of claim 8, wherein the first activity includes: walking, running, biking, swimming, or climbing.

15. A presentation component for presenting a multimedia presentation of a first user performing a first activity at a first geographic location, the presentation component comprising:

a reception component located where a second user is performing a second activity, wherein the reception component is located geographically remotely from a data capture component and is configured to:

receive real-time visual data captured by a visual capture component of the data capture component, wherein the real-time visual data is associated with the first activity performed by the first user, receive real-time movement data captured by a motion capture component of the data capture component, wherein the real-time movement data is associated with the first user during performance of the first activity; and receive data associated with the one or more geographic locations of the first user determined by a location determination component of the data capture component during performance of the first activity, wherein the reception component is configured to receive the real-time visual data, the real-time movement data, and the data associated with the one or more geographic locations of the first user from a mobile device associated with the first user;

a processing component, wherein the processing component is configured to process the received real-time visual data, real-time movement data, and data associated with the one or more geographic locations of the first user; and a display component, wherein the display component is configured to display a representation of the processed data to the second user.

16. The presentation component of claim 15, wherein the display component is a display associated with a treadmill, a stationary bike, a rowing machine, or a stepping machine.

17. The presentation component of claim 15, wherein the display component is a display associated with a pair of glasses.

18. The presentation component of claim 15, wherein the second activity includes: walking, running, biking, swimming, or climbing.

19. A presentation component for presenting a multimedia presentation of a first user performing a first activity at a first geographic location, the presentation component comprising:

a reception component located where a second user is performing a second activity, wherein the reception component is located geographically remotely from a data capture component and is configured to:

receive real-time visual data captured by a visual capture component of the data capture component, wherein the real-time visual data is associated with the first activity performed by the first user, receive real-time movement data captured by a motion capture component of the data capture component, wherein the real-time movement data is associated with the first user during performance of the first activity; and receive data associated with the one or more geographic locations of the first user determined by a location determination component of the data capture component during performance of the first activity, wherein the reception component is configured to receive the real-time visual data, the real-time movement data, and the data associated with the one or more geographic locations of the first user from a mobile device associated with the second user;

a processing component, wherein the processing component is configured to process the received real-time visual data, real-time movement data, and data associated with the one or more geographic locations of the first user; and a display component, wherein the display component is configured to display a representation of the processed data to the second user.

20. The presentation component of claim 19, wherein the display component is a display associated with a treadmill, a stationary bike, a rowing machine, or a stepping machine.

21. The presentation component of claim 19, wherein the display component is a display associated with a pair of glasses.

22. The presentation component of claim 19, wherein the second activity includes: walking, running, biking, swimming, or climbing.

* * * * *